US011686091B2

(12) United States Patent
Pring

(10) Patent No.: US 11,686,091 B2
(45) Date of Patent: Jun. 27, 2023

(54) FASTENERS AND WALL ASSEMBLIES

(71) Applicant: Glen Haydn Pring, Helensvale (AU)

(72) Inventor: Glen Haydn Pring, Helensvale (AU)

( * ) Notice: Subject to any disclaimer, the term of this patent is extended or adjusted under 35 U.S.C. 154(b) by 0 days.

(21) Appl. No.: 16/498,611

(22) PCT Filed: Mar. 29, 2018

(86) PCT No.: PCT/AU2018/000047
§ 371 (c)(1),
(2) Date: Sep. 27, 2019

(87) PCT Pub. No.: WO2018/176077
PCT Pub. Date: Oct. 4, 2018

(65) Prior Publication Data

US 2021/0108410 A1 Apr. 15, 2021

(30) Foreign Application Priority Data

Mar. 31, 2017 (AU) ..... 2017901181
Jul. 24, 2017 (AU) ..... 2017902893
Aug. 9, 2017 (AU) ..... 2017903164

(51) Int. Cl.
*E04B 2/82* (2006.01)
*E04B 1/94* (2006.01)
(Continued)

(52) U.S. Cl.
CPC ..... *E04B 2/825* (2013.01); *E04B 1/943* (2013.01); *E04H 9/02* (2013.01); *E04B 2002/7481* (2013.01)

(58) Field of Classification Search
CPC . E04B 2/825; E04B 2/828; E04B 2/82; E04B 2/7475; E04B 2/7411; E04B 2/768;
(Continued)

(56) References Cited

U.S. PATENT DOCUMENTS

D10,410 S 1/1878 Reed
375,206 A 12/1887 Shelton
(Continued)

FOREIGN PATENT DOCUMENTS

CN 107130710 A * 9/2017
CN 111236498 A * 6/2020
(Continued)

*Primary Examiner* — Ryan D Kwiecinski
(74) *Attorney, Agent, or Firm* — Bonini IP Law, LLC; Frank J. Bonini, Jr.

(57) ABSTRACT

A wall assembly (10) comprising top and bottom caps (11) and (12) which are generally U shaped channels and these are secured to a floor (13) and a concrete slab ceiling (14) which comprises in this case the underside of a concrete floor of the next level in a multi-storey building. In these arrangements the ceiling (14) has to be arranged in relation to the wall (15) for deflection of the ceiling (14), consequentially, the track (11) is spaced from the underside surface (16) by a distance of typically 20 mm and a suitable compressible spacer arrangement (17) is located between the upper surface (18) of the track (11) and the underside surface (16). The spacer arrangement (17) may be any suitable infill and one example may be a fire rated double sided adhesive layered expandable/compressible tape or foam. This tape may be applied to the upper outer surface of the channel and its other side adhesively applied to the underside of the concrete.

18 Claims, 13 Drawing Sheets

(51) Int. Cl.
*E04H 9/02* (2006.01)
*E04B 2/74* (2006.01)

(58) Field of Classification Search
CPC . E04B 1/948; E04B 2002/7481; E04H 9/021; E04H 9/02; E04H 9/024
See application file for complete search history.

(56) References Cited

U.S. PATENT DOCUMENTS

D35,710 S 2/1902 Stickley
2,940,495 A 2/1957 Wing
3,309,825 A 3/1967 Zinn et al.
D245,147 S 7/1977 Ono
D248,824 S 8/1978 Imai et al.
4,164,971 A 8/1979 Strand
5,056,975 A 10/1991 Ando
5,199,152 A 4/1993 Wagner
5,255,647 A 10/1993 Kiczek
5,374,146 A 12/1994 Allen
5,913,788 A 6/1999 Herren
D418,048 S 12/1999 Chan
D418,743 S 1/2000 Hollis
D419,431 S 1/2000 Hollis
6,058,668 A 5/2000 Herren
D433,621 S 11/2000 Wiley
6,176,665 B1 1/2001 Bondarowicz et al.
7,293,392 B2 11/2007 Krumbacher
D584,137 S 1/2009 Edge, Jr.
D605,500 S 12/2009 Lee et al.
7,752,817 B2 7/2010 Pilz et al.
7,966,778 B2 * 6/2011 Klein ..... E04B 2/825 52/167.1
8,132,376 B2 3/2012 Pilz et al.
8,245,469 B2 8/2012 Rubel et al.
8,281,552 B2 * 10/2012 Pilz ..... E04C 3/09 52/846
8,413,394 B2 4/2013 Pilz et al.
8,458,972 B1 * 6/2013 Stodola ..... E04B 2/825 52/284
8,499,512 B2 8/2013 Pilz et al.
8,544,226 B2 10/2013 Rubel
8,555,566 B2 10/2013 Pilz et al.
8,590,231 B2 11/2013 Pilz
8,595,999 B1 12/2013 Pilz et al.
8,950,132 B2 * 2/2015 Collins ..... E04B 2/28 52/234
8,973,319 B2 3/2015 Pilz et al.
9,045,899 B2 6/2015 Pilz et al.
D741,159 S 10/2015 Campbell
9,163,444 B1 * 10/2015 Fontijn ..... E05D 15/0621
9,290,934 B2 3/2016 Pilz et al.
D764,267 S 8/2016 Hutter, III
9,458,628 B2 10/2016 Pilz et al.
9,523,193 B2 12/2016 Pilz
9,719,253 B2 * 8/2017 Stahl, Jr. ..... E04B 1/94
9,739,054 B2 8/2017 Pilz et al.
D807,736 S 1/2018 Adriano
9,869,085 B2 * 1/2018 Evans ..... F16M 13/027
9,879,369 B2 1/2018 Timac et al.
10,563,399 B2 * 2/2020 Pilz ..... E04B 1/38
10,753,084 B2 * 8/2020 Pilz ..... E04B 1/948
2005/0120661 A1 * 6/2005 Paul ..... E04B 2/767 52/633
2006/0032157 A1 * 2/2006 Baryla ..... E04H 9/02 52/654.1
2006/0120826 A1 6/2006 Wieser et al.
2009/0038764 A1 2/2009 Pilz
2009/0178363 A1 7/2009 Pilz
2009/0178369 A1 * 7/2009 Pilz ..... E04B 1/943 52/656.1
2011/0005155 A1 1/2011 Pilz
2011/0283643 A1 11/2011 Rubel et al.
2011/0286814 A1 * 11/2011 Hettich ..... F16B 35/041 411/386
2012/0066989 A1 3/2012 Pilz
2012/0155986 A1 6/2012 Schaser
2012/0233945 A1 9/2012 Rubel
2012/0311950 A1 12/2012 Rubel et al.
2013/0186020 A1 7/2013 Pilz
2013/0219815 A1 8/2013 Pilz et al.
2014/0075865 A1 3/2014 Pilz et al.
2014/0130433 A1 5/2014 Pilz et al.
2015/0247320 A1 9/2015 Pilz et al.
2015/0275510 A1 * 10/2015 Klein ..... E04B 2/7411 52/232
2015/0337530 A1 11/2015 Pilz et al.
2016/0017599 A1 1/2016 Klein et al.
2016/0201319 A1 7/2016 Pilz
2016/0265219 A1 9/2016 Pilz
2017/0032157 A1 2/2017 Tuttle
2017/0175386 A1 6/2017 Pilz
2017/0234004 A1 8/2017 Pilz
2018/0030726 A1 2/2018 Pilz et al.
2019/0127974 A1 * 5/2019 Dicaire ..... E04B 1/947
2020/0270857 A1 * 8/2020 Herfurth ..... E04B 9/008
2020/0325679 A1 * 10/2020 Pilz ..... E04B 2/7457
2020/0332511 A1 * 10/2020 Ishaq ..... E04B 1/08

FOREIGN PATENT DOCUMENTS

DE 20115715 U1 * 1/2002 ..... E04B 2/82
GB 461706 A 2/1937
WO 20120125760 A2 9/2012
WO WO-2016205119 A1 * 12/2016 ..... E04B 2/825
WO WO-2018176077 A1 * 10/2018 ..... E04B 1/943
WO WO-2019091593 A1 * 5/2019 ..... E04B 1/36

* cited by examiner

GRAPH 1.

FASTENERS AND WALL ASSEMBLIES

TECHNICAL FIELD

This invention relates to fasteners in particular but not limited to fasteners utilised in deflection situations where it is desirable to provide for deflection between a wall assembly and an associated floor or substrate to which that wall assembly is connected.

BACKGROUND

There are known arrangements for placement of wall frames utilising tracks or the like with an upper track secured to a roof or ceiling at the head end and a lower track secured to the floor with the wall frame studs between them. This can be between concrete slabs as for example in multi storey buildings where the upper track is positioned in order to take into account vertical deflection of the slab relative to the wall. While these arrangements have been around for many years there have not been any efforts to improve the structural integrity of the connection of the track to the concrete slab particularly in shear across the plane of the wall at the head. The patent literature provides examples of various combinations that have their own advantages and disadvantages, some of course have never actually been used. The following are examples and although these documents have been listed these are from a post invention search and do not constitute an admission of common general knowledge in Australia or anywhere else.

US Patent Application 2006/0032157 (Baryla et al) describes a "Seismic Wall System" where a top track is loosely secured for axial relative movement and studs are floating within the frame. An essential requirement of this system is relative vertical movement between the studs and top track with the studs being positioned by notches in the tracks both top and bottom. Since there is no coupling between the studs and tracks, the stud to track interface is inherently weak. US Patent Applications 2016/0201319 and 2017/0032157 (both to Pilz) describe a fire-rated head of wall joint where an insert or layered insert between a head track and ceiling expands upon heating. The head track is secured by standard concrete screws and is spaced by a gap from the ceiling above by reason of the inserts. Similar is U.S. Pat. No. 3,309,825 (Zinn et al). The present invention does not use inserts to set the gap. GB 461,706 (Fisk) describes a sound absorbing partition wall that permits ventilation and accounts for any vibration in floor or ceiling. The walls are mounted top and bottom using 'floating" screws where the spacing of the frame is by felt spacers.

It should be clear that walls have been used for many years. The above are non-limiting examples and it should also be appreciated that the art of internal walls and their constructions is a "well developed" or "crowded art".

It is with this background in mind that the present invention was given birth, the present invention arises through the inventor's desire to provide a useful alternative to the prior art and in response to the inventor's quite unexpected finding that material could be saved and existing walls could be strengthened by simple modification of existing arrangements in track securement and frame coupling to the track. This means for any given BMT (base metal thickness) the present invention yields greater strength.

All of the prior art arrangements have the disadvantages of being either very complex or have structural weaknesses or do not efficiently employ the materials used in an environmentally friendly manner.

Accordingly, it would be desirable to provide a fastening arrangement which improves the structural integrity of the connection of the track and hence the associated wall to the concrete slab above it as well as simplify the construction method and optimise the materials used to save costs and make a sustainable and environmentally friendly system by achieving structural gains with less material.

Outline

In one aspect therefore there is provided a wall frame comprising top and bottom tracks secured to top and bottom surfaces, spaced studs extending between the channels in fixed spaced relation to form with the top and bottom tracks a rigid frame, spaced fasteners used to secure the tracks to the surfaces and to account for surface deflection each fastener comprising a hold section, a head and a deflection guide slideway in axial slidable engagement with the track to account for surface deflection, the fastener having a stop adapted to set the distance of the head from the surface and thereby set the track distance from the surface.

In another aspect there is provided a fastener used to secure a track in fixed spaced relation to a surface to account for surface deflection and for the mounting of a wall in the track, the fastener comprising a hold section, typically a thread, a head and a deflection guide slideway in axial slidable engagement with the track to account for deflection. The deflection guide slideway is typically a shank section of the fastener and having a physical stop to limit penetration of the hold section. Preferably, the physical stop has an associated locating means such that the fastener is able to locate the track in its operative position. In one form the physical stop and locating means has a stop face. Typically, the stop face is an end of the shank adjacent the thread. In a preferred form the deflection guide slide is a cylindrical section of the fastener and the stop face is an annular shoulder proud of the thread with the thread terminating adjacent the stop face. The deflection guide slideway preferably extends from one end of the the hold section to the head, the effect being that when the stop face is hard up against the surface the head is at a predetermined distance from the surface and this distance is substantially the same for all the fasteners along the track. Preferably, the head has a flange adapted to be secured in register with the track at a predetermined distance from the surface and the shank providing a dowel function enabling sliding movement of the fastener relative to the track in order to take account of deflection of the surface relative to the track. The present invention is typically employed at the top or bottom of a vertical wall. The fastener may be unitary or of two parts.

In a second aspect there is provided a heavy duty wall track space setting fastener being unitary or of two parts having a hold section, a head section and an axially extending deflection guide slideway between the head and hold section and a transversely extending stop face at a hold section end of the deflection guide slideway. The deflection guide slideway is typically a dowel section and the stop face is an outer edge of one end of the dowel section at a juncture between the dowel section and the hold section. The hold section is typically a thread, the deflection guide slideway is a cylinder and the stop face is an outer edge of one end of the cylinder adjacent to a thread termination.

In another aspect there is provided a wall assembly comprising an upper track, a lower track, wall frame elements extending between the tracks, the upper track being spaced from an adjacent surface and being in axial slidable engagement with spaced fasteners, each fastener having a deflection guide slideway passing through the track. Typically, each fastener has a spacer with a stop setting a space between the track and then secured into concrete and having track sections with fasteners according to the above securing the track in the concrete at a distance determined by the length of the shank of the fastener. Typically a gap is formed above the track and a filler or spacer arrangement is employed in the gap. The spacer arrangement may be any suitable infill and one example may be a fire/acoustic rated single sided adhesive layered expandable/compressible tape or foam. This tape may be adhesively applied to the upper outer surface of the channel and its other side compresses against the underside of the surface above the track.

In a still further aspect there is provided a wall frame track having spaced guideways through which deflection guide slideways pass. These guideways are typically spaced holes in a crown section of the track. The spaced holes may be elongated slots. The track preferably has at least one sidewall and cladding is secured to the sidewall either on it inside or outside using suitable fasteners. Typically, there is a top and bottom track supporting a wall and the tracks are each generally in a channel having spaced said side walls and cladding secured to the side walls with spaced fasteners.

In another preferred form there is provided an in situ rigid wall assembly comprising an upper track, a lower track, wall frame elements extending between the tracks and being fixed to the tracks, the wall assembly being secured to concrete surfaces via the tracks, the upper track having axially spaced and axially extending slots and being spaced from an adjacent said concrete surface and being in axial slidable engagement with spaced fasteners passing through each of the slots, each fastener having a deflection guide slideway passing through the track and a stop setting a gap between the track and the concrete determined by the position of the stop, a filler or spacer arrangement employed in the gap and wall cladding secured to the wall frame elements and to the tracks. In case where the frame elements align with the head of a fastener it is preferable to have a gap to accommodate the head. In the case of a channel stud there is a U-shaped cut out to accommodate the head.

In a still further aspect there is provided a method to secure a wall track to a surface comprising:

- preparing a wall frame track with spaced guideways through which deflection guide slideways can pass;
- providing a fastener having a hold section, typically a thread, a head and a deflection guide slideway;
- securing the track using the hold section of the fasteners with the deflection guide slideway being in axial slidable engagement in the guideway to account for deflection, the fastener automatically setting the track spacing from the surface.

The method may further comprise using a track connector bracket between sections of track. Preferably, the track connector bracket coincides in use at a location with or without a vertical stud. Typically, the vertical stud is secured to the connected track ends through gaps in the bracket. Preferably, the track ends first over the bracket and the method includes sliding and end of a further track over an already fastened track section and bracket and subsequently securing the further track using said fasteners and also to the bracket.

Preferably, the track ranges in width from 64 mm to 150 mm with a base metal thickness ranging from 0.5 mm-1.5 mm and with guideways comprising axially spaced slots with a slot length ranging from 60 mm-310 mm. The slots may be evenly spaced. More preferably, the slot to wall height may be selected from the following table:

| Distance between storeys (mm) | Internal wall height - Assuming 300 mm slab (mm) | Required slot length - including 9 mm Bolt diameter (mm) |
|---|---|---|
| 2000 | 1700 | 69 |
| 2100 | 1800 | 72 |
| 2200 | 1900 | 75 |
| 2300 | 2000 | 78 |
| 2400 | 2100 | 81 |
| 2500 | 2200 | 84 |
| 2600 | 2300 | 87 |
| 2700 | 2400 | 90 |
| 2800 | 2500 | 93 |
| 2900 | 2600 | 96 |
| 3000 | 2700 | 99 |
| 3100 | 2800 | 102 |
| 3200 | 2900 | 105 |
| 3300 | 3000 | 108 |
| 3400 | 3100 | 111 |
| 3500 | 3200 | 114 |
| 3600 | 3300 | 117 |
| 3700 | 3400 | 120 |
| 3800 | 3500 | 123 |
| 3900 | 3600 | 126 |
| 4000 | 3700 | 129 |
| 4100 | 3800 | 132 |
| 4200 | 3900 | 135 |
| 4300 | 4000 | 138 |
| 4400 | 4100 | 141 |
| 4500 | 4200 | 144 |
| 4600 | 4300 | 147 |
| 4700 | 4400 | 150 |
| 4800 | 4500 | 153 |
| 4900 | 4600 | 156 |
| 5000 | 4700 | 159 |
| 5100 | 4800 | 162 |
| 5200 | 4900 | 165 |
| 5300 | 5000 | 168 |
| 5400 | 5100 | 171 |
| 5500 | 5200 | 174 |
| 5600 | 5300 | 177 |
| 5700 | 5400 | 180 |
| 5800 | 5500 | 183 |
| 5900 | 5600 | 186 |
| 6000 | 5700 | 189 |
| 6100 | 5800 | 192 |
| 6200 | 5900 | 195 |
| 6300 | 6000 | 198 |
| 6400 | 6100 | 201 |
| 6500 | 6200 | 204 |
| 6600 | 6300 | 207 |
| 6700 | 6400 | 210 |
| 6800 | 6500 | 213 |
| 6900 | 6600 | 216 |
| 7000 | 6700 | 219 |
| 7100 | 6800 | 222 |
| 7200 | 6900 | 225 |
| 7300 | 7000 | 228 |
| 7400 | 7100 | 231 |
| 7500 | 7200 | 234 |
| 7600 | 7300 | 237 |
| 7700 | 7400 | 240 |
| 7800 | 7500 | 243 |
| 7900 | 7600 | 246 |
| 8000 | 7700 | 249 |
| 8100 | 7800 | 252 |
| 8200 | 7900 | 255 |
| 8300 | 8000 | 258 |
| 8400 | 8100 | 261 |
| 8500 | 8200 | 264 |
| 8600 | 8300 | 267 |
| 8700 | 8400 | 270 |
| 8800 | 8500 | 273 |
| 8900 | 8600 | 276 |
| 9000 | 8700 | 279 |
| 9100 | 8800 | 282 |
| 9200 | 8900 | 285 |

-continued

| Distance between storeys (mm) | Internal wall height - Assuming 300 mm slab (mm) | Required slot length - including 9 mm Bolt diameter (mm) |
|---|---|---|
| 9300 | 9000 | 288 |
| 9400 | 9100 | 291 |
| 9500 | 9200 | 294 |
| 9600 | 9300 | 297 |
| 9700 | 9400 | 300 |
| 9800 | 9500 | 303 |
| 9900 | 9600 | 306 |
| 10000 | 9700 | 309 |

BRIEF DESCRIPTION OF THE DRAWINGS

In order that the present invention may be more readily understood and be put into practical effect reference will now be made to the accompanying drawings which illustrate preferred embodiments of the invention as applied at the top of a vertical wall but it will be appreciated that the top track may be at the bottom of the wall and wherein:—

METHOD OF PERFORMANCE

Figure 1:
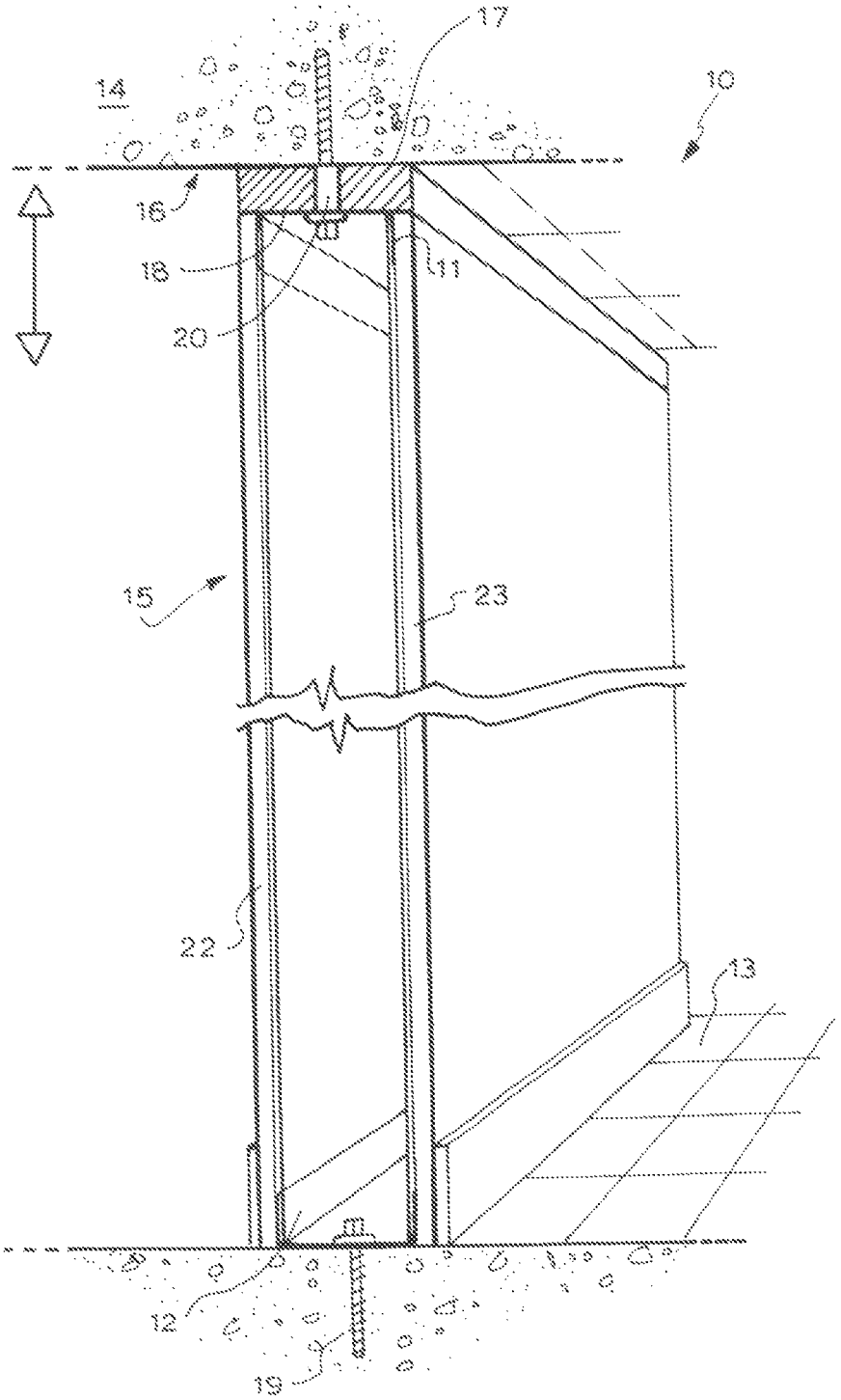
FIG. 1 is a cutaway view illustrating a wall assembly according to one aspect of the present invention.

Referring to the drawings and initially to FIG. 1 there is illustrated a wall assembly 10 comprising top and bottom caps 11 and 12 which are generally U shaped channels and these are secured to a floor 13 and a concrete slab ceiling 14 which comprises in this case the underside of a concrete floor of the next level in a multi-storey building.

In these arrangements the ceiling 14 has to be arranged in relation to the wall 15 for deflection of the ceiling 14, consequentially, the track 11 is spaced from the underside surface 16 by a distance of typically 20 mm and a suitable compressible spacer arrangement 17 is located between the upper surface 18 of the track 11 and the underside surface 16. The spacer arrangement 17 may be any suitable infill and one example may be a fire/acoustic rated single sided adhesive layered expandable/compressible tape or foam. This tape may be applied adhesively to the upper outer surface of the channel and its other side compresses against the underside of the concrete.

The lower track 12 is secured using concrete screws 19 which are located at spaced intervals along the track 12. In order that the track 11 may be secured in place fasteners 20 according to the present invention secure the track at spaced intervals along the track into the concrete slab 14.

Figure 2:
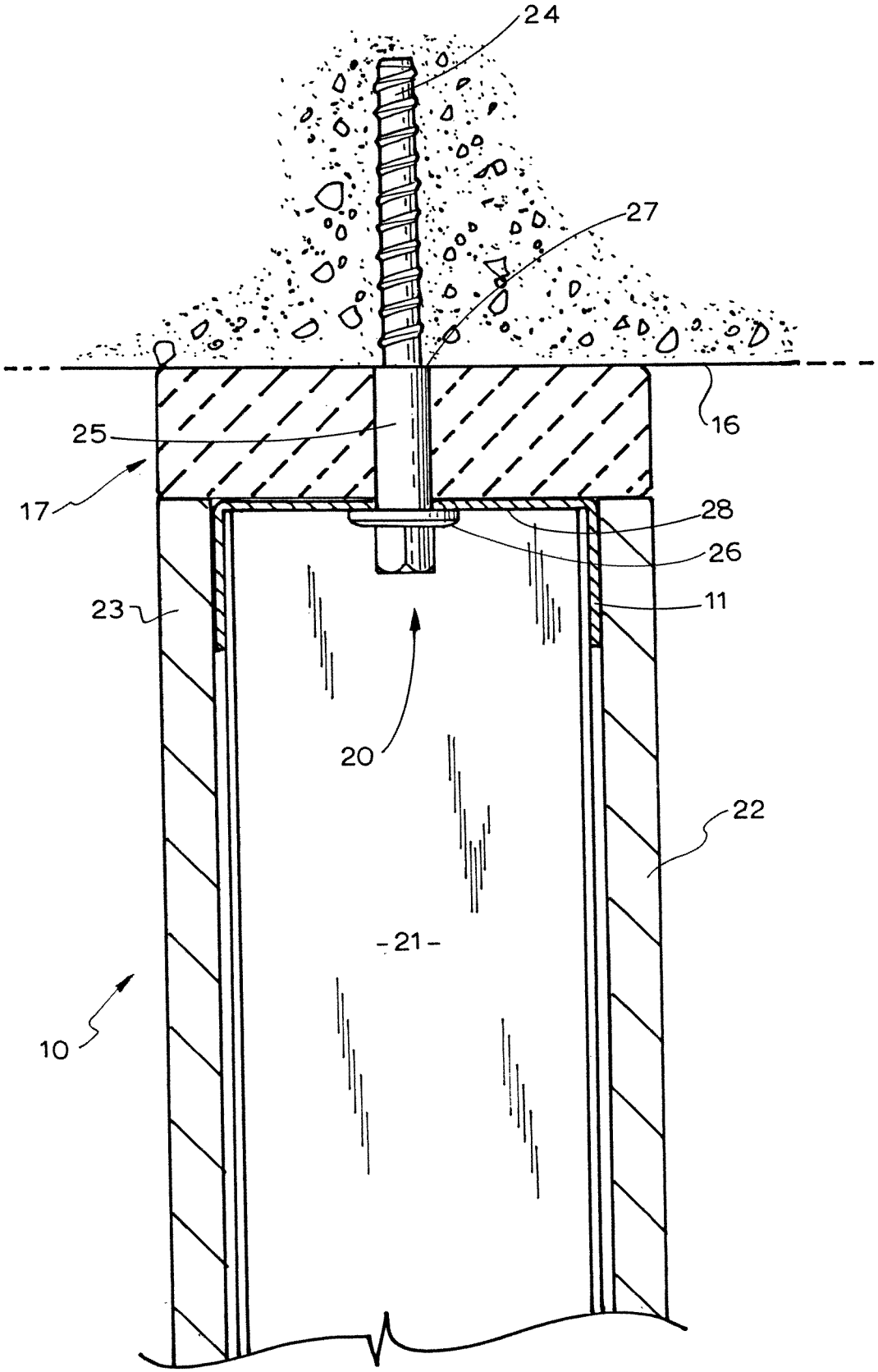
FIG. 2 is a close up of the top section of a typical wall assembly.

Referring now to FIG. 2 the top of the wall assembly 10 is illustrated in close up view whereby there is shown a stud 21 which fits inside the track 11 and then there is outer cladding 22, 23 applied to complete the assembly. The fastener 20 includes a hold section in this case in the form of a thread 24, there is a deflection guide slideway in the form of cylindrical shank 25 and there is a flanged head 26 of conventional hex form, the shank 25 having a stop face comprising in this example as an annular shoulder 27 which as can be seen serves as a stop to set the spacing between the underside 16 of the concrete slab and the top 28 of the track 11.

Figure 3:
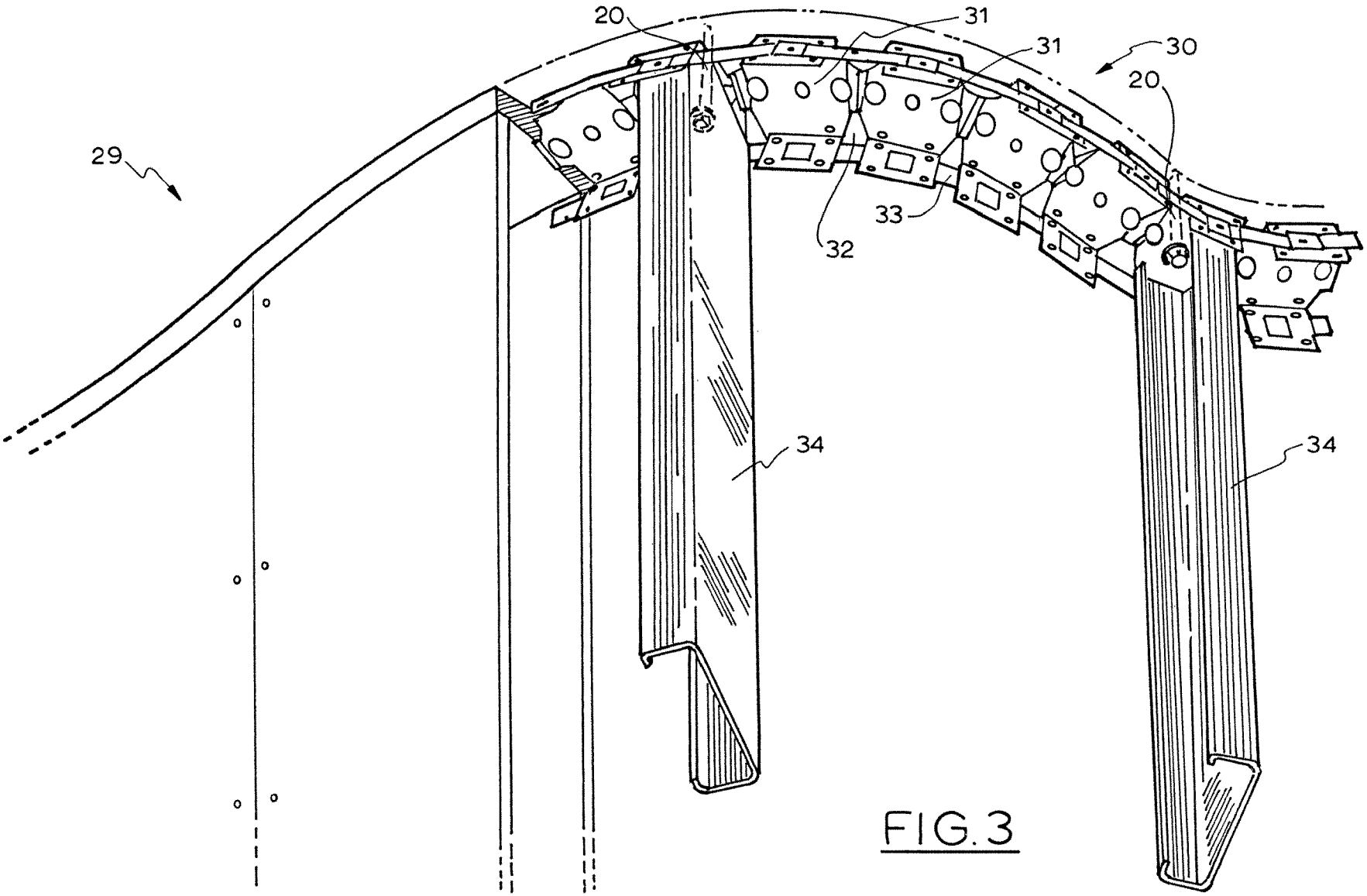
FIG. 3 is a drawing illustrating application of the present invention to a curved wall.
Figure 4:
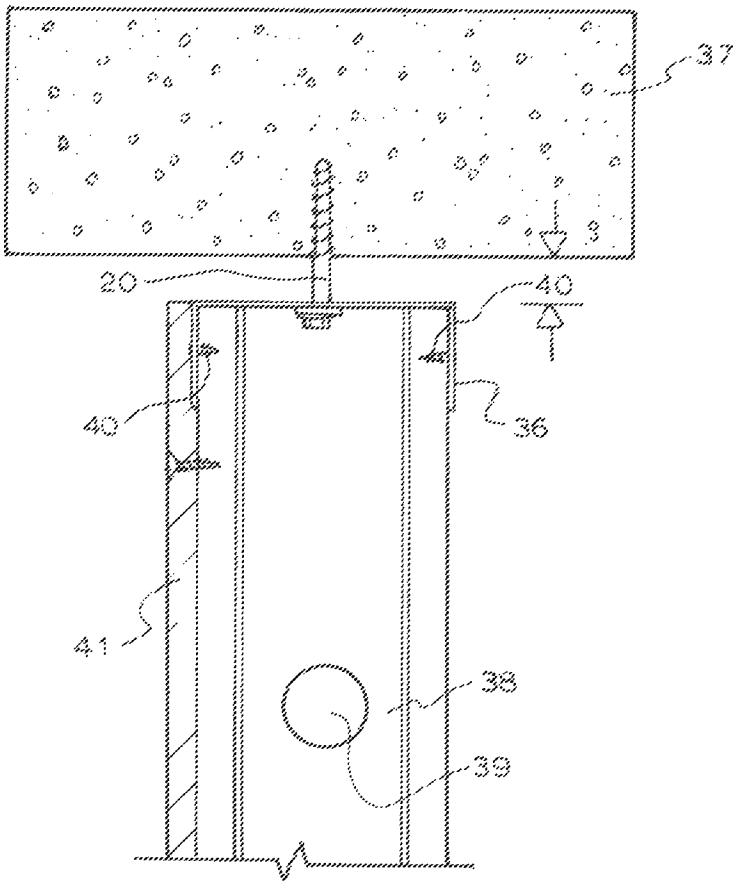
FIG. 4 is a part view showing part of a typical assembly process.
Figure 5:
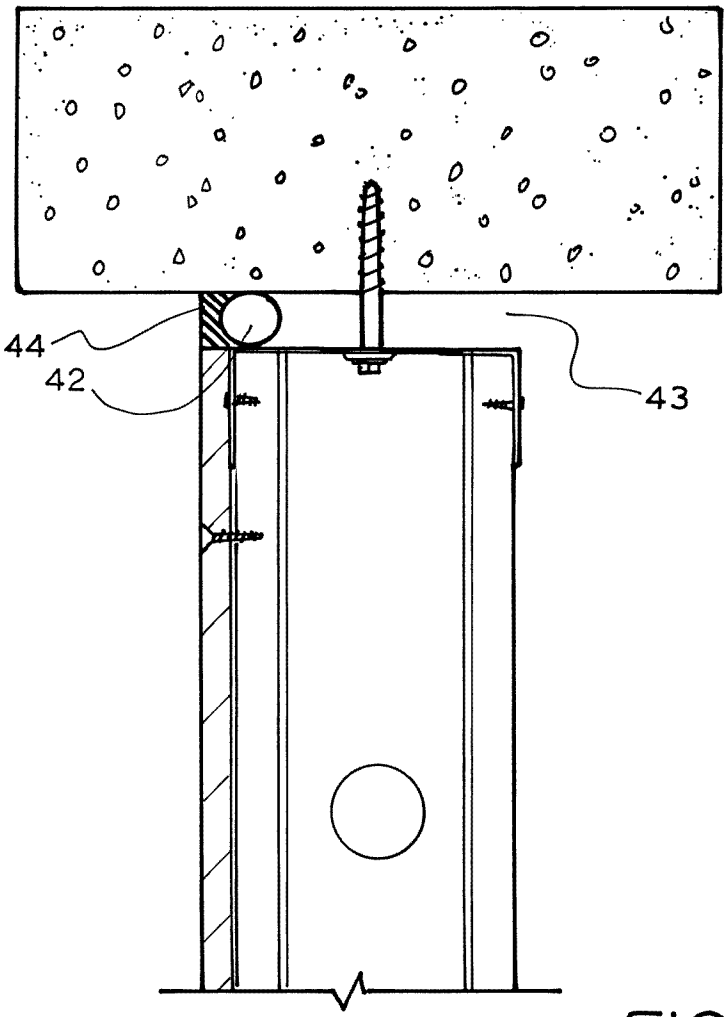
FIG. 5 is a possible next step.

Referring to FIG. 3 there is illustrated application of the present invention to a curved wall assembly which in this case employs a track 30 made up of individual segments 31 which have a flexible bridge 32 and are interconnected by a flexible strap 33 so that a curved track may be formed. Studs 34 are secured into the track as shown with fasteners 20 as previously described located at stud centers to secure the track to the concrete or other deflectable surface in fixed spaced relationship according to the length of the shank of the fastener 20.

It will be appreciated by reason of the shank 25 and the self drilling capability of the thread on the fastener 20 that it is a simple matter to utilise the fastener 20 which is in the form of a heavy duty fastener at stud centers along the length of the track. This provides a very secure arrangement for simply and easily marking out centres and drilling and then securing the track in position while at the same time catering for the shank to enable the deflection allowance as prescribed for this type of assembly.

FIGS. 4 through 7 illustrate typical assembly arrangements of a wall assembly according to the present invention utilising a fastener 20. The track 36 has been secured in place by fasteners 20, screwed into the slab 37 and studs 38 have also been secured, in this case the studs 38 have service holes 39 and these are aligned along the wall assembly. The fastener 20 operates as a deflection screw bolt inserted through the head track and fixed into the slab with the anchor points at stud centers. Screws 40 secure the track to the studs. After the top and bottom tracks and studs have been located then a plasterboard is secured as shown with sheet 41 suitably secured.

Figure 6:
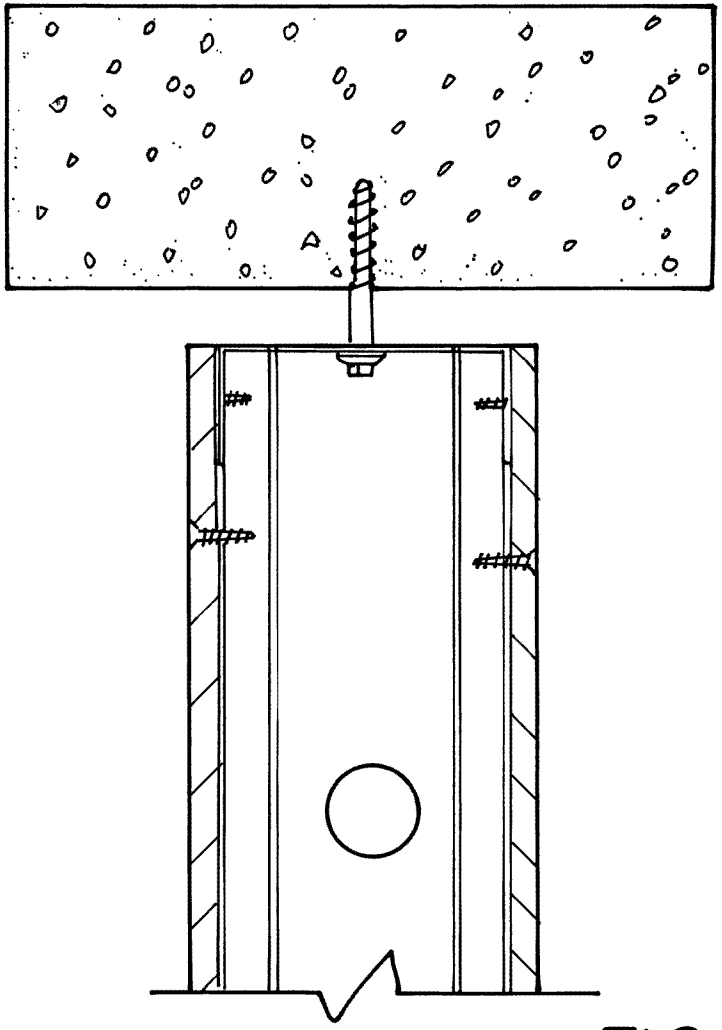
FIG. 6 is a further possible next following the view of FIG. 5.
Figure 7:
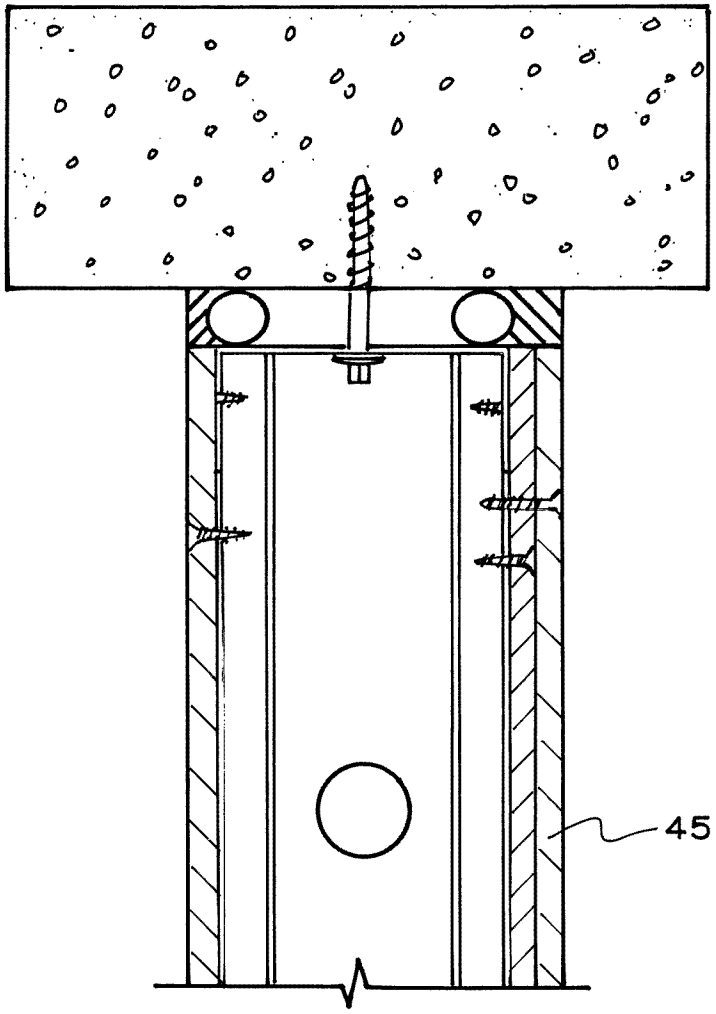
FIG. 7 is a possible final view.

The plasterboard is secured with screws. An open cell compressible backing rod 42 is secured and located in the 20 mm gap 43 and then a sealant 44 is applied to fill the gap between the top of the plasterboard and the underside of the slab. The plasterboard may typically be fire rated as is the sealant. This is repeated as illustrated in FIGS. 6 and 7. As additionally shown in FIG. 7 an additional sheet of plasterboard may be utilised at 45 as may other cladding be used depending upon the requirements of the space as is a custom in the usual way.

Figure 8:
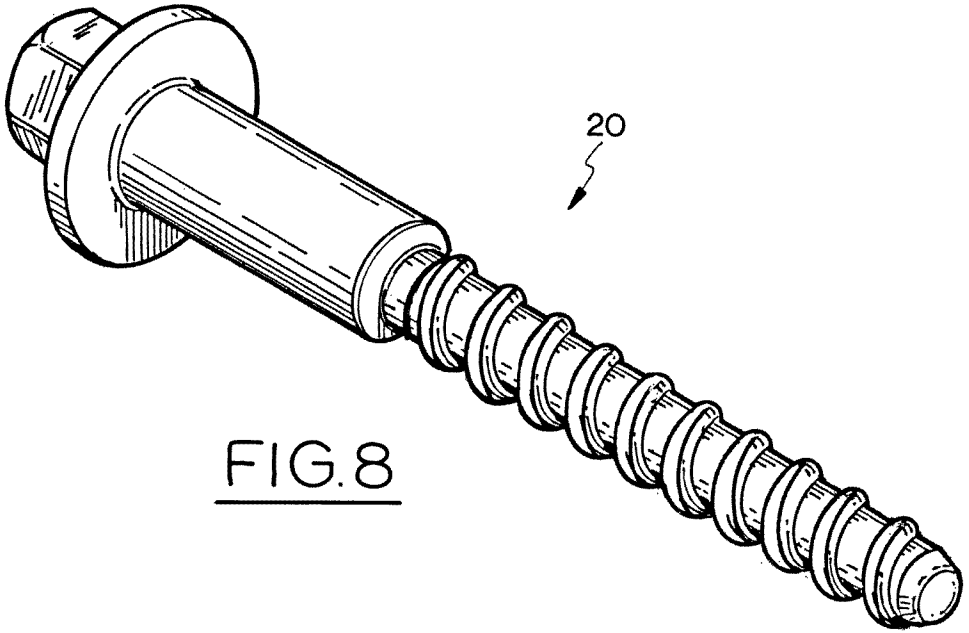
FIG. 8 is a view of a typical fastener.
Figure 9:
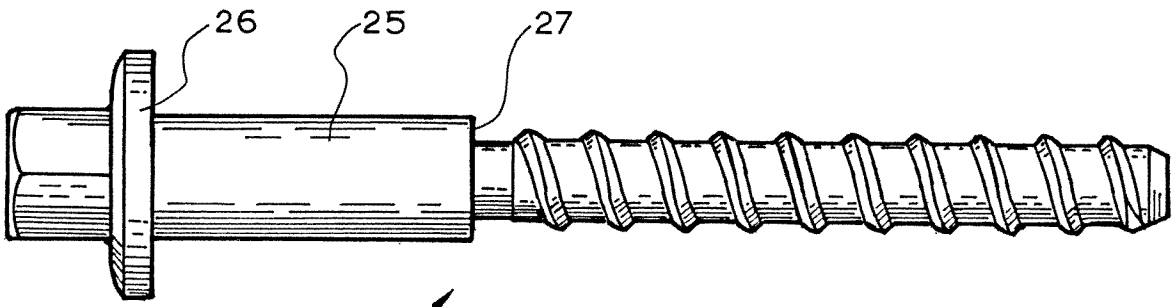
FIG. 9 is a side view of the fastener of FIG. 8.
Figure 10:
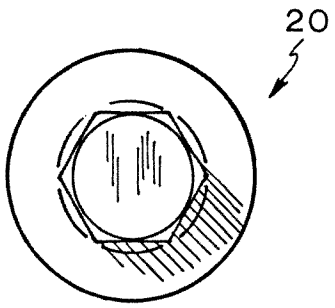
FIG. 10 is a top view of the fastener of FIG. 8.

Referring now to FIGS. 8 through 10 the preferred form of fastener 20 is illustrated which in this case has a total length of 75 mm and most importantly the shank 25 is in this case set at 20 mm from the flange 26 so that the stop shoulder 27 may operate to secure a track at this preset distance so that it is a simple matter to rapidly and quickly utilise ordinary tooling and equipment to put a track in position.

Figure 11:
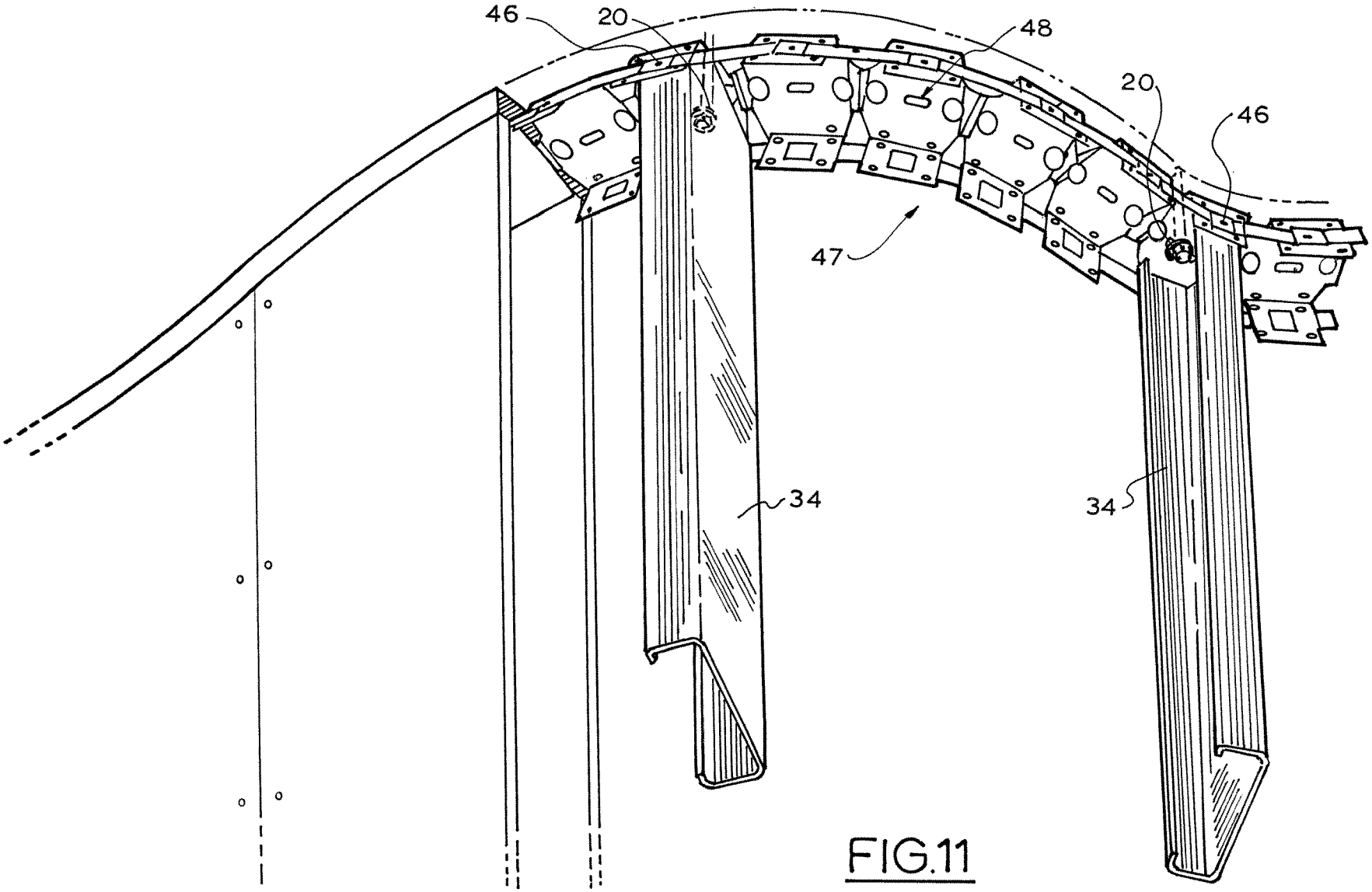
FIGS. 11 and 12 are to a further embodiments similar to FIGS. 1 and 3 where cladding is secured to the outside of a typical track using spaced fasteners at any location along the tracks.

Referring now to FIG. 11 another embodiment is illustrated. Like numerals illustrate like features. As in the previous embodiment it will be understood the track 11 secured to upper ends of the studs 34 at 46 on opposite sides. In this case the track 47 differs from the track 11 in so far as the holes 48 are elongated in the axial direction of the track. This permits limited movement in the axial direction. This is particularly useful in case of ground movements as in for example, during an earthquake. In all other respects the track is the same. The fasteners 20 are at the same centres as the studs. Fastener spacing may vary depending on the track material thickness.

Figure 12:
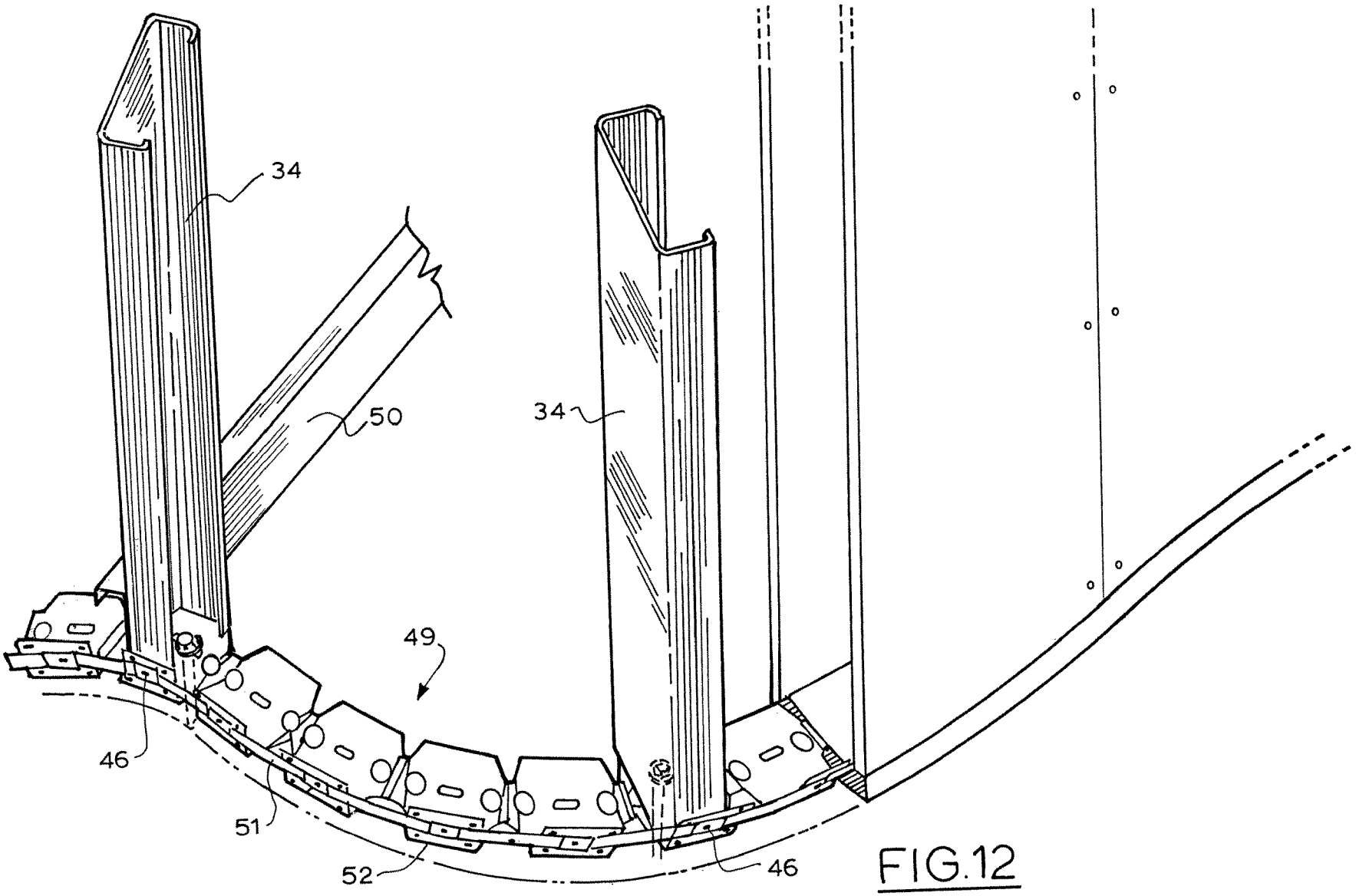

FIG. 12 illustrates a track arrangement 49 that may be used at the lower end of a ceiling bulkhead or the like of the type customarily involving a frame. The upper end not shown may correspond to the preceding drawings in FIGS. 1-11. One frame member of the ceiling underside frame is shown at 50 to which plasterboard or other cladding may be fixed in the usual way. The track 49 has a strap 51 passing through flange section 52 but there is no corresponding flange and strap on the inside. In all other aspects this is the same track. It may have elongated holes. It is fixed to the studs as shown.

In each of the embodiments the track material may be made from lesser or thicker and stronger metals as may be desired by the application. In some cases it may be desirable to make the track self holding from thicker material one example being 0.75 mm Zincalume (registered trade mark of Bluescope Steel) or similar may be used and in this case it is possible to omit the straps 51 altogether. In this case the fastener spacing may be further apart but of course the fastener spacing may be selected according to need.

Figure 13:
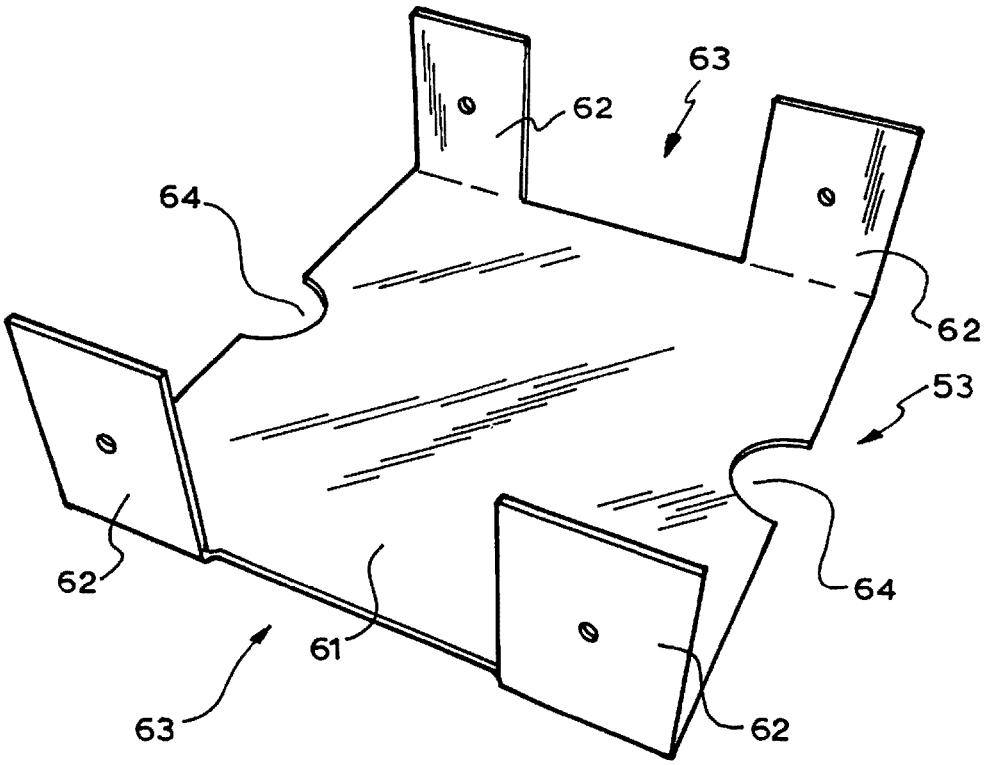
FIG. 13 is a connector bracket that may be used to secure to section of track.
Figure 14:
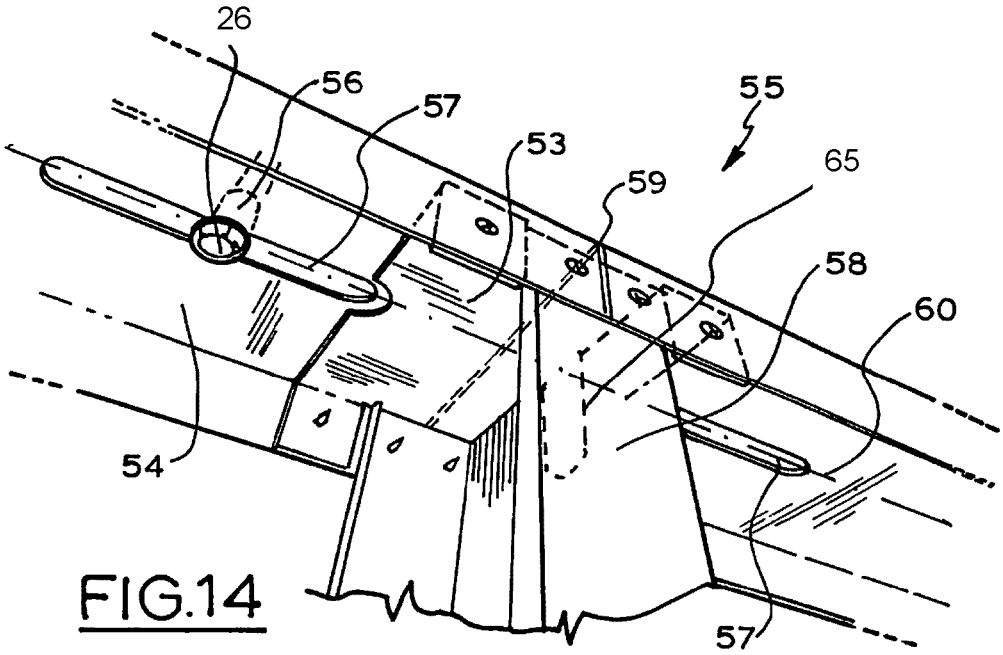
FIG. 14 is a drawing showing use of the connector bracket at the juncture of two track ends and a stud.

In order for track sections to be joined a connector bracket illustrated in FIG. 13 may be used in the arrangement of FIG. 14. In FIG. 14 only part of the bracket has been shown in phantom to show its position as have the ends of the respective tracks and the ends of the stud. Referring to FIGS. 13 and 14 a connector bracket 53 fits inside and is secured to track 54 which together are secured to roof 55 using spaced fasteners, one being shown at 56, passing through slots 57. This mode of connecting the track 54 is effectively the arrangement of the previous embodiments, so the roof may float above the track. A vertical internal wall with studs 58 is rigidly connected back to the floor.

It will be appreciated that once the bracket 53 and the track section 54 is secured then the end 59 of a second track section 60 may be manually located above the bracket 53 to abut with the end of track section 54 and before securing the track 60 to the bracket 53, the track section 60 may be secured at its far end using a fastener 56. Further fasteners 56 may be added. The stud 58 may be added later. It will be appreciated that the installation of the track sections in this case can then be a single man operation. A bracket similar to bracket 53 may be employed with curved track sections.

The bracket 53 has a crown 61, corner flanges 62 used to secure the track sections and stud openings 63 used to enable the tracks to be secured directly to the stud 58. There are also cut outs 64 in the bracket and U-shaped cut out 65 (shown in phantom in FIG. 14) in the stud 58, these being to accommodate the head 26 of fasteners 56 to the full length of adjustment or movement available from slots 57. This gap 65 caters for the variable position of the studs and their alignment with the fasteners at these locations.

Figure 15:
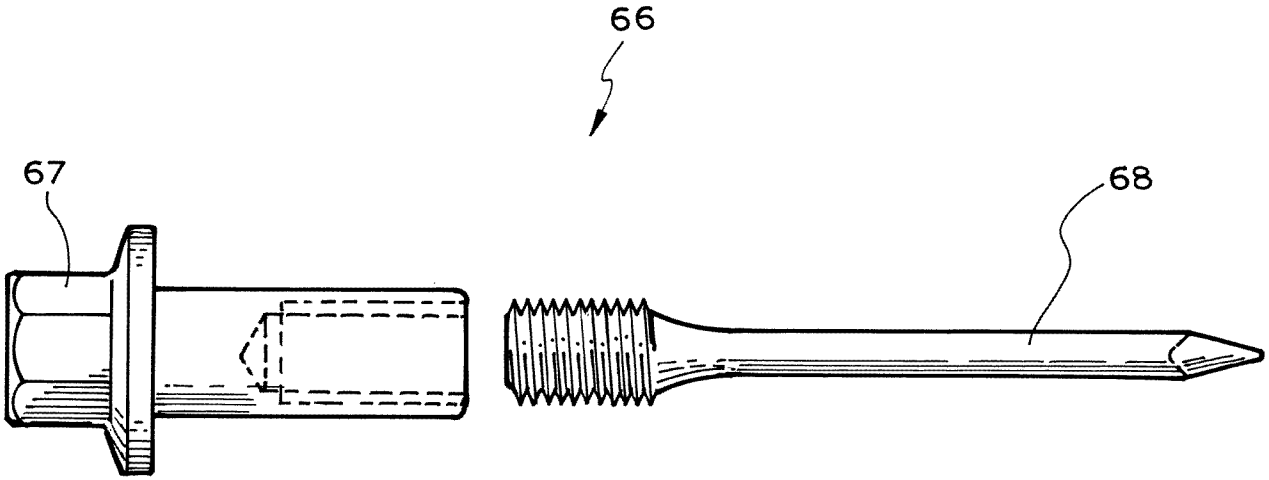
FIG. 15 is an exploded view of an alternative fastener.

Referring now to FIG. 15 there is illustrated an alternative fastener 66 formed from an internally threaded head end 67 and a complementary nail end 68. The ends are shown separated in FIG. 15 but it will be appreciated that they are screwed together to form the fastener. The nail end is a standard threaded concrete nail for use with a nail gun so that the nail end may be fired into position and then the head end is used to secure the tracks in position. It will be appreciated that any equivalent form of concrete connection may be employed.

Examples

The below is what has been tested at the testing facilities to date with all (BMT) Base Metal Thickness of the tracks. Track length is typically 2400 mm upwards, stud spacing, and fastener spacing and plasterboard applied according to industry norms.

| 64 mm Width Track, 0.55 mm, 0.75 mm, 1.15 mm (BMT) | |
|---|---|
| 110 mm slot | 235 mm slot |

| 76 mm Width Track, 0.55 mm, 0.75 mm, 1.15 mm (BMT) | |
|---|---|
| 110 mm slot | 235 mm slot |

| 92 mm Width Track, 0.55 mm, 0.75 mm, 1.15 mm (BMT) | | |
|---|---|---|
| 110 mm slot | 235 mm slot | 309 mm slot |

| 150 Width Track, 0.75 mm, 1.15 mm (BMT) | | |
|---|---|---|
| 110 mm slot | 235 mm slot | 309 mm slot |

All elongated slots are 10 mm wide in all track widths (64 mm, 76 mm, 92 mm, 150 mm). All setup passed the AS 1170.4-2007 as set out below. Applicant is confident of compliance with other standards. Present commonly used arrangements do not comply.

With the present invention one can cut elongated slots up to 309 mm long. In the present examples these specific lengths in testing (110 mm, 235 mm 309 mm slots) were testing the strengths for the most commonly use track width (64 mm, 76 mm, 92 mm, 150 mm) and ("BMT") Base Metal Thickness, 0.55 mm, 0.75 mm, 1.15 mm in the field taking into account the inter-story drift limits required to be satisfied with typical government legislation, to gauge the strength of the system. It was found that the present invention produced greater strength in sheer than present systems (which do not satisfy current standards) but with lower base metal thickness, thus providing overall long term savings in metal used while at the same time meeting safety standard for floor and roof deflection.

In the examples a 110 mm slot will cover walls up to 3.0 m in height, a 235 mm slot will cover walls up to 7.2 m in height and a 309 mm slot will cover walls up to 10.0 m in height.

Of course other options are possible, for example one could produce a 150 mm slot as this will cover most commonly used height walls of up to 4.5 m. This may cover approximately 80% of walls being built in the market.

Typically, slots from 80 mm in length through to 309 mm in length (as per the table below) will cover all wall systems that can be constructed as per typical legislation, for example Australian Standard AS 1170.4-2007, that walls must cater for a inter-story drift of up to 1.5% of the storey height for each level.

AS 1170.4-2007 (Incorporating Amendment Nos 1 and 2) Structural design actions

Part: Earthquake action in Australia 54.4 Drift

The inter-storey drift at the ultimate limit state calculated from the forces determined in Clause 5.4.2 shall not exceed 1.5% of the storey height for each level (see Clause 6.7.2).

The table below sets out approximate slot lengths for wall height using 9 mm fasteners through the slots at nominal 600 mm centres as described above with standard stud and fastener locations and 13 mm plasterboard fitted to each side of the wall. Foam sealant was applied in the 20 mm gap between the top track and the underside of the concrete. The tests were repeated with foam strips.

TABLE 1

| Distance between storeys (mm) | Internal wall height - Assuming 300 mm slab (mm) | Required slot length - including 9 mm Bolt diameter (mm) |
|---|---|---|
| 2000 | 1700 | 69 |
| 2100 | 1800 | 72 |
| 2200 | 1900 | 75 |
| 2300 | 2000 | 78 |
| 2400 | 2100 | 81 |
| 2500 | 2200 | 84 |
| 2600 | 2300 | 87 |
| 2700 | 2400 | 90 |
| 2800 | 2500 | 93 |
| 2900 | 2600 | 96 |
| 3000 | 2700 | 99 |
| 3100 | 2800 | 102 |
| 3200 | 2900 | 105 |
| 3300 | 3000 | 108 |
| 3400 | 3100 | 111 |
| 3500 | 3200 | 114 |
| 3600 | 3300 | 117 |
| 3700 | 3400 | 120 |
| 3800 | 3500 | 123 |
| 3900 | 3600 | 126 |
| 4000 | 3700 | 129 |
| 4100 | 3800 | 132 |
| 4200 | 3900 | 135 |
| 4300 | 4000 | 138 |
| 4400 | 4100 | 141 |
| 4500 | 4200 | 144 |
| 4600 | 4300 | 147 |
| 4700 | 4400 | 150 |
| 4800 | 4500 | 153 |
| 4900 | 4600 | 156 |
| 5000 | 4700 | 159 |
| 5100 | 4800 | 162 |
| 5200 | 4900 | 165 |
| 5300 | 5000 | 168 |
| 5400 | 5100 | 171 |
| 5500 | 5200 | 174 |
| 5600 | 5300 | 177 |
| 5700 | 5400 | 180 |
| 5800 | 5500 | 183 |
| 5900 | 5600 | 186 |
| 6000 | 5700 | 189 |
| 6100 | 5800 | 192 |
| 6200 | 5900 | 195 |
| 6300 | 6000 | 198 |
| 6400 | 6100 | 201 |
| 6500 | 6200 | 204 |
| 6600 | 6300 | 207 |

TABLE 1-continued

| Distance between storeys (mm) | Internal wall height - Assuming 300 mm slab (mm) | Required slot length - including 9 mm Bolt diameter (mm) |
|---|---|---|
| 6700 | 6400 | 210 |
| 6800 | 6500 | 213 |
| 6900 | 6600 | 216 |
| 7000 | 6700 | 219 |
| 7100 | 6800 | 222 |
| 7200 | 6900 | 225 |
| 7300 | 7000 | 228 |
| 7400 | 7100 | 231 |
| 7500 | 7200 | 234 |
| 7600 | 7300 | 237 |
| 7700 | 7400 | 240 |
| 7800 | 7500 | 243 |
| 7900 | 7600 | 246 |
| 8000 | 7700 | 249 |
| 8100 | 7800 | 252 |
| 8200 | 7900 | 255 |
| 8300 | 8000 | 258 |
| 8400 | 8100 | 261 |
| 8500 | 8200 | 264 |
| 8600 | 8300 | 267 |
| 8700 | 8400 | 270 |
| 8800 | 8500 | 273 |
| 8900 | 8600 | 276 |
| 9000 | 8700 | 279 |
| 9100 | 8800 | 282 |
| 9200 | 8900 | 285 |
| 9300 | 9000 | 288 |
| 9400 | 9100 | 291 |
| 9500 | 9200 | 294 |
| 9600 | 9300 | 297 |
| 9700 | 9400 | 300 |
| 9800 | 9500 | 303 |
| 9900 | 9600 | 306 |
| 10000 | 9700 | 309 |

Sheer load testing of the various track, stud and fastener combinations in the above BMTs for the tracks demonstrated stud to track failure, at displacement of 6 mm-10 mm and ranging from applied loads of 2.5 kN for the thinner tracks to 7 kN for thicker tracks. These tests employed a 600 mm test rig with tracks of the type shown in FIG. 3 top and bottom, two studs and fasteners at 300 mm centres. There were no effects on the fasteners at stud to track failure.

Figure 16:
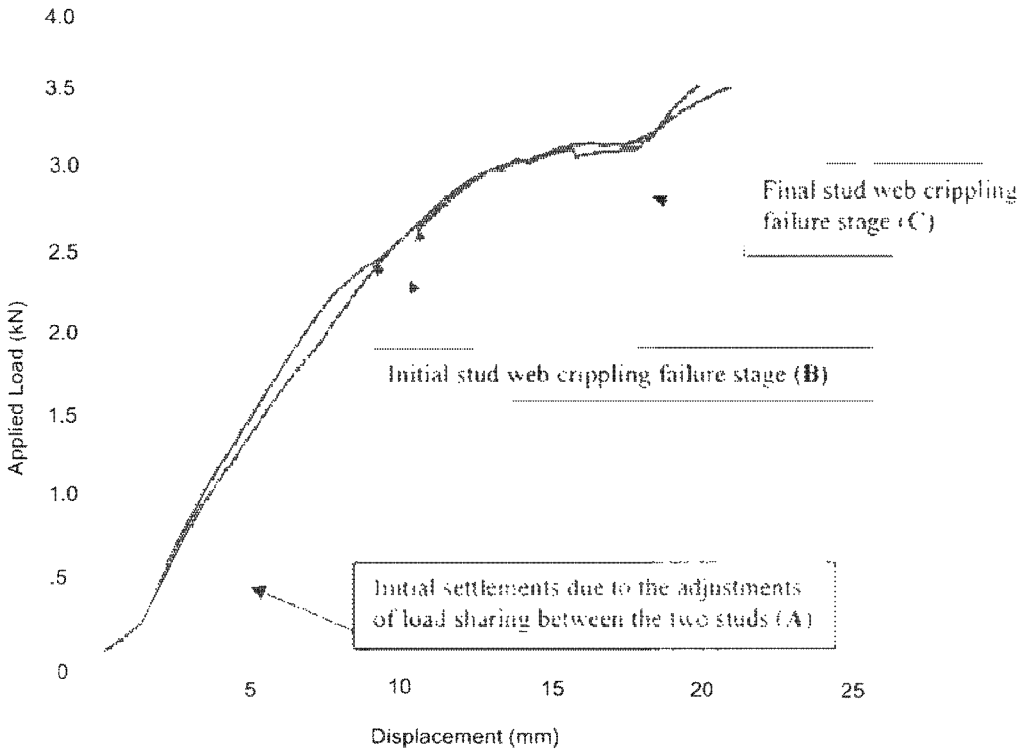
FIG. 16 as a graph which is exemplary of the displacement of a stud track interface according other present under applied load.

Graph 1. Shown in FIG. 16 is exemplary of the displacement of the stud track interface under applied load for 51 mm ID wide track at 0.55 mm thick and matching studs at 51 mm wide and 0.5 mm thick.

The next test involved testing straight track sections to determine the deformation of the slots about the fastener connections. A small test rig was used to apply sheer to a section of track until the track deformed about the fastener.

The test results are shown in Tables 2 and 3 using a track and 9 mm fastener of the type illustrated in FIGS. 1 and 2. Table 2 shows the track dimensions and Table 3 shows the results confirming that the use of the present invention achieves loading beyond the requirements of the established standards while in combination optimising the thickness of the materials employed.

TABLE 2

| Test Designation | Channel Width (mm) | Channel Thickness (mm) | Slot length (mm) |
|---|---|---|---|
| 1 | 64 | 0.7 | 80 |
| 2 | 64 | 0.7 | 80 |
| 3 | 76 | 0.7 | 80 |
| 4 | 76 | 0.7 | 80 |
| 5 | 92 | 0.7 | 80 |

TABLE 2-continued

| Test Designation | Channel Width (mm) | Channel Thickness (mm) | Slot length (mm) |
|---|---|---|---|
| 6 | 92 | 0.7 | 80 |
| 7 | 150 | 0.7 | 80 |
| 8 | 150 | 0.7 | 80 |
| 9 | 64 | 1.15 | 80 |
| 10 | 64 | 1.15 | 80 |
| 11 | 76 | 1.15 | 80 |
| 12 | 76 | 1.15 | 80 |
| 13 | 92 | 1.15 | 80 |
| 14 | 92 | 1.15 | 80 |
| 15 | 150 | 1.15 | 80 |
| 16 | 150 | 1.15 | 80 |
| 17_300 mm | 92 | 1.15 | 300 |
| 18 | 64 | 0.7 | 80 |

TABLE 3

| Test Designation | Width (mm) | Thickness (mm) | Ultimate Load (N) | Failure Mode |
|---|---|---|---|---|
| 1 | 64 | 0.7 | 2 888 | Flange buckling |
| 2 | 64 | 0.7 | 2 697 | Web and flange buckling |
| 18 | 64 | 0.7 | 2 980 | Flange buckling |
| 3 | 76 | 0.7 | 3 275 | Flange buckling |
| 4 | 76 | 0.7 | 3 403 | Flange buckling |
| 5 | 92 | 0.7 | 3 951 | Web buckling |
| 6 | 92 | 0.7 | 4 046 | Web buckling |
| 7 | 150 | 0.75 | 3 926 | Web buckling |
| 8 | 150 | 0.75 | 3 834 | Web buckling |
| 9 | 64 | 1.15 | 5 602 | Flange buckling |
| 10 | 64 | 1.15 | 5 750 | Flange buckling |
| 11 | 76 | 1.15 | 6 681 | Flange buckling |
| 12 | 76 | 1.15 | 6 899 | Flange buckling |
| 13 | 92 | 1.15 | 8 714 | Flange buckling |
| 14 | 92 | 1.15 | 8 884 | Flange buckling |
| 15 | 150 | 1.15 | 8 402 | Web buckling |
| 16 | 150 | 1.15 | 8 150 | Web buckling |
| 17 (30 mm slot) | 92 | 1.15 | 5 006 | Web buckling |

Whilst the above has been given by way of illustrative example many variations and modifications will be apparent to those skilled in the art without departing from the broad ambit and scope of the invention as set out in the appended claims.

The invention claimed is:

1. A wall frame comprising top and bottom tracks secured to top and bottom surfaces, the tracks having channels accommodating spaced studs extending between the top and bottom tracks in fixed spaced relation to form with the top and bottom tracks a rigid frame, inhibiting any vertical movement of the studs relative to the top or bottom tracks, the top track having axially spaced axially extending slots of predetermined length, spaced fasteners used to secure the tracks to the surfaces and with some of said fasteners passing through the slots in the top track, each fastener passing through the slots in the top track comprising a hold section penetrating the top surface, a head and a deflection guide slideway in the form of a cylinder movable up, down and along the respective slot to account for surface deflection, the fastener having a stop comprising one end of the cylinder adapted to set a distance of the head from the top surface and thereby set the track distance from the top surface, the track distance set being for the sole purpose of accommodating vertical displacement of the top surface, the studs being rigid with the tracks to inhibit relative movement between the studs and the tracks while the distance of the head from the top surface and the predetermined length of the slots is selected to accommodate top surface movement by permitting relative movement between the top track and the fasteners due to said surface deflection of the said top surface, the fasteners being chosen such that shear load testing of the stud track and fastener combination demonstrates a stud track and fastener combination demonstrates a stud to track failure at 6 mm-10 mm deflection and ranging from applied loads of 2.5 kN to 7 kN with no effect on the fasteners.

2. A wall frame according to claim 1 wherein the deflection guide slideway extends from a stop face located at one end of the hold section and along the fastener to the head, the effect being that when the stop face is hard up against the top surface the head is at a predetermined distance from the top surface and this distance from the top surface is substantially the same for all the fasteners along the track.

3. A wall frame according to claim 2, wherein the deflection guide slideway is a shank section of the fastener and the stop face comprises a physical stop to limit penetration of the hold section into the top surface, and wherein the head has a flange adapted to be secured in register with the track at a predetermined distance from the top surface determined by the stop face and the shank providing a dowel function enabling sliding movement of the fastener relative to the track in order to take account of deflection of the surface relative to the track.

4. A wall frame according to claim 1, wherein the deflection guide slideway is a shank section of the fastener and the stop comprises a physical stop to limit penetration of the hold section into the top surface, and wherein the head has a flange adapted to be secured in register with the track at a predetermined distance from the top surface determined by the stop and the shank section providing a dowel function enabling sliding movement of the fastener relative to the track in order to take account of deflection of the top surface relative to the track.

5. The wall frame of claim 1 wherein each fastener has a transversely extending stop face at a hold section end of the deflection guide slideway.

6. The wall frame of claim 1 wherein the deflection guide slideway is a dowel section and there is a stop face as an outer edge of one end of the dowel section at a juncture between the dowel section and the hold section.

7. A wall frame according to claim 1 wherein at least one stud has a side wall edge extending across the top track, the side wall edge having an end gap to accommodate a head of a said fastener.

8. A wall frame according to claim 1, wherein the top and bottom tracks define an internal wall height between the top and bottom surfaces, and the slots have a slot length selected according to the internal wall height.

9. An in situ rigid wall assembly comprising an upper track, a lower track, wall frame elements extending between the tracks and being fixed to the tracks, the wall assembly being secured to concrete surfaces, the upper track having axially spaced and axially extending slots of predetermined length and being spaced from an adjacent said concrete surface and being in axial slidable engagement with spaced fasteners passing through each of the slots, each fastener having a deflection guide slideway passing through the track and a stop setting a gap of predetermined width between the track and the adjacent said concrete surface determined by the position of the stop, a filler or spacer arrangement employed in the gap and wall cladding secured to the wall frame elements and to the tracks, the slot length and gap width being selected to accommodate movement of the adjacent said concrete surface, the fasteners being chosen such that shear load testing of the stud track and fastener combination demonstrates a stud track and fastener combination demonstrates a stud to track failure at 6 mm-10 mm deflection and ranging from applied loads of 2.5 kN to 7 kN with no effect on the fasteners.

10. An in situ rigid wall assembly according to claim 9 wherein each said track ranges in width from 64 mm to 150 mm with a base metal thickness ranging from 0.5 mm-1.5 mm and with guideways comprising axially spaced slots with a slot length ranging from 60 mm-310 mm.

11. An in situ rigid wall assembly according to claim 9 wherein each slot has a defined slot length and in multistory buildings the relationship between the distance between storeys, the internal wall height and slot length is such that the slot length is longer for greater distances between storeys.

12. A method to secure a wall track to an underside of a surface comprising:

preparing a wall frame track with axially spaced guideways through which respective deflection guide slideways can pass for predetermined movement in concert with the surface and within the guideways;

providing fasteners, each having a hold section, a head and a deflection guide slideway;

securing the track using the hold section of the fasteners with the deflection guide slideway of each fastener being able to move in its respective guideway to account for surface deflection, the fastener automatically setting track spacing from the surface, the fasteners being chosen such that shear load testing of the stud track and fastener combination demonstrates a stud track and fastener combination demonstrates a stud to track failure at 6 mm-10 mm deflection and ranging from applied loads of 2.5 kN to 7 kN with no effect on the fasteners.

13. The method of claim 12 further comprising:

using a track connector bracket between sections of track;

the track connector bracket coinciding in use at a location with a one of said vertical frame elements.

14. The method of claim 12 further comprising:

using a track connector bracket between sections of track;

the track connector bracket coinciding in use at a location with one of said vertical frame elements, said one of the vertical frame elements being secured to the said section of track through gaps in a said connector bracket.

15. The method of claim 12 further comprising:

using a track connector bracket between sections of track;

the track connector bracket coinciding in use at a location with a vertical frame element, locating a track end first over a connector bracket and securing the track end and connector bracket to a concrete roof; and sliding an end of a further track over the already fastened track section and bracket and subsequently securing the further track with the track section in alignment using said fasteners along the further track and also securing it to the bracket.

16. A method according to claim 12 including the further step of having a head of a said fastener position in a gap in an end of a vertical frame element.

17. A multi-storey building comprising a rigid wall assembly according to claim 9 in a multi-storey building where the wall assembly is an internal wall, wherein the track ranges in width from 64 mm to 150 mm with a base metal thickness ranging from 0.5 mm-1.5 mm and with guideways comprising axially spaced slots with a slot length selected according to the following table depending on distance between storeys and internal wall height:

| Distance between storeys (mm) | Internal wall height - Assuming 300 mm slab (mm) | Required slot length - including 9 mm Bolt diameter (mm) |
|---|---|---|
| 2000 | 1700 | 69 |
| 2100 | 1800 | 72 |
| 2200 | 1900 | 75 |
| 2300 | 2000 | 78 |
| 2400 | 2100 | 81 |
| 2500 | 2200 | 84 |
| 2600 | 2300 | 87 |
| 2700 | 2400 | 90 |
| 2800 | 2500 | 93 |
| 2900 | 2600 | 96 |
| 3000 | 2700 | 99 |
| 3100 | 2800 | 102 |
| 3200 | 2900 | 105 |
| 3300 | 3000 | 108 |
| 3400 | 3100 | 111 |
| 3500 | 3200 | 114 |
| 3600 | 3300 | 117 |
| 3700 | 3400 | 120 |
| 3800 | 3500 | 123 |
| 3900 | 3600 | 126 |
| 4000 | 3700 | 129 |
| 4100 | 3800 | 132 |
| 4200 | 3900 | 135 |
| 4300 | 4000 | 138 |
| 4400 | 4100 | 141 |
| 4500 | 4200 | 144 |
| 4600 | 4300 | 147 |
| 4700 | 4400 | 150 |
| 4800 | 4500 | 153 |
| 4900 | 4600 | 156 |
| 5000 | 4700 | 159 |
| 5100 | 4800 | 162 |
| 5200 | 4900 | 165 |
| 5300 | 5000 | 168 |
| 5400 | 5100 | 171 |
| 5500 | 5200 | 174 |
| 5600 | 5300 | 177 |
| 5700 | 5400 | 180 |
| 5800 | 5500 | 183 |
| 5900 | 5600 | 186 |
| 6000 | 5700 | 189 |
| 6100 | 5800 | 192 |
| 6200 | 5900 | 195 |
| 6300 | 6000 | 198 |
| 6400 | 6100 | 201 |
| 6500 | 6200 | 204 |
| 6600 | 6300 | 207 |
| 6700 | 6400 | 210 |
| 6800 | 6500 | 213 |
| 6900 | 6600 | 216 |
| 7000 | 6700 | 219 |
| 7100 | 6800 | 222 |
| 7200 | 6900 | 225 |
| 7300 | 7000 | 228 |
| 7400 | 7100 | 231 |
| 7500 | 7200 | 234 |
| 7600 | 7300 | 237 |
| 7700 | 7400 | 240 |
| 7800 | 7500 | 243 |
| 7900 | 7600 | 246 |
| 8000 | 7700 | 249 |
| 8100 | 7800 | 252 |
| 8200 | 7900 | 255 |
| 8300 | 8000 | 258 |
| 8400 | 8100 | 261 |
| 8500 | 8200 | 264 |
| 8600 | 8300 | 267 |
| 8700 | 8400 | 270 |
| 8800 | 8500 | 273 |
| 8900 | 8600 | 276 |
| 9000 | 8700 | 279 |
| 9100 | 8800 | 282 |
| 9200 | 8900 | 285 |

-continued

| Distance between storeys (mm) | Internal wall height - Assuming 300 mm slab (mm) | Required slot length - including 9 mm Bolt diameter (mm) |
|---|---|---|
| 9300 | 9000 | 288 |
| 9400 | 9100 | 291 |
| 9500 | 9200 | 294 |
| 9600 | 9300 | 297 |
| 9700 | 9400 | 300 |
| 9800 | 9500 | 303 |
| 9900 | 9600 | 306 |
| 10000 | 9700 | 309 |

18. A wall frame comprising top and bottom tracks secured to top and bottom surfaces, spaced studs extending between the top and bottom tracks in fixed spaced relation to form with the top and bottom tracks a rigid frame, spaced fasteners used to secure the tracks to the surfaces and to account for surface deflection each fastener comprising a hold section, a head and a deflection guide slideway in axial slidable engagement with the top track to account for surface deflection, the fastener having a stop adapted to set the distance of the head from the top surface and thereby set the track distance from the top surface, the studs being rigid with the tracks to inhibit relative movement between the studs and the tracks while permitting relative movement between the top track and the fasteners due to said surface deflection of the said top surfaces;

wherein at least one stud has a side wall edge extending across the top track, the side wall edge having an end gap to accommodate a head of a said fastener.

* * * * *